United States Patent [19]

Satake

[11] Patent Number: 4,515,075

[45] Date of Patent: May 7, 1985

[54] RICE POLISHING MACHINE

[75] Inventor: Toshihiko Satake, Higashihiroshima, Japan

[73] Assignee: Satake Engineering Co. Ltd., Tokyo, Japan

[21] Appl. No.: 609,807

[22] Filed: May 14, 1984

[30] Foreign Application Priority Data

Jul. 15, 1983 [JP] Japan ..... 58-129786

[51] Int. Cl.[3] ..... B02B 3/00; B02B 7/02

[52] U.S. Cl. ..... 99/519; 99/528; 99/606; 99/611

[58] Field of Search ..... 99/518, 519, 520, 523–525, 99/528, 602, 605, 606, 607, 609–611, 612–614, 618, 619; 426/481–483; 241/6, 7, 244–246

[56] References Cited

FOREIGN PATENT DOCUMENTS 255684 of 0000 Japan .

*Primary Examiner*—Timothy F. Simone

*Attorney, Agent, or Firm*—Bert J. Lewen

[57] ABSTRACT

A rice polishing machine comprises a rotatable shaft, a polishing roll mounted on the shaft for rotation therewith, and a perforated cylindrical polishing assembly disposed in substantially concentric relation to the shaft. The cylindrical polishing assembly has its inner circumferential surface which cooperates with an outer circumferential surface of the polishing roll to define therebetween a polishing chamber. Partition wall members engage with an outer circumferential surface of the cylindrical polishing assembly at a location below an axis of the shaft for dividing the outer circumferential surface into an arcuate bottom surface section and the remaining arcuate surface section and for defining an upper space to which the bottom surface section is exposed and a lower space to which the remaining surface section is exposed. An air delivery device delivers air such that the air is introduced from the lower space into the polishing chamber through apertures in the bottom surface section and then to be introduced from the polishing chamber into the upper space through apertures in the remaining surface section. The air introduced from the lower space into the polishing chamber through the apertures in the bottom surface section of the perforated cylindrical polishing assembly imparts an upward force to the rice grains which are liable to be collected and stagnated in the lower portion of the polishing chamber, to thereby make the rice grains uniform in density around the entire polishing chamber.

12 Claims, 7 Drawing Figures

RICE POLISHING MACHINE

BACKGROUND OF THE INVENTION

1. Field of the Invention

The present invention relates to a machine for polishing rice grains to remove bran from a surface of each rice grain.

2. Description of the Prior Art

For example, as disclosed in the Japanese Patent Publication No. 34-4765 (Patent No. 255684) to Satake, a conventional rice polishing machine comprises a frame, a shaft mounted on the frame for rotation about an axis extending generally horizontally, a polishing roll mounted on the shaft for rotation therewith, and a perforated cylindrical polishing member mounted on the frame in concentric relation to the shaft. The perforated cylindrical polishing member cooperates with the polishing roll to define a polishing chamber therebetween. Each of a pair of partition wall members extends in parallel to the shaft and has one longitudinal side edge sealingly engaging with an outer circumferential surface of the perforated cylindrical polishing member at a location above the shaft and the other longitudinal side edge fixed to the frame, to thereby divide the outer circumferential surface of the perforated cylindrical polishing member into an arcuate top surface section and the remaining arcuate surface section and to define substantially closed upper and lower spaces. The arcuate top surface section and the remaining arcuate surface section of the perforated cylindrical polishing member are exposed to the upper and lower spaces, respectively. A blower communicates with the upper space to discharge air therefrom.

When the shaft is rotated, the rice grains to be polished are supplied into the polishing chamber, and the polishing roll is rotated to polish the rice grains within the polishing chamber, to thereby remove bran from the surface of each rice grain. An air flow generated by the blower is introduced from the lower space into the polishing chamber through apertures in the remaining arcuate surface section of the perforated cylindrical polishing member, and, subsequently is introduced from the polishing chamber to the upper space through apertures in the arcuate top surface section of the perforated cylindrical polishing member, thereby discharging the removed bran from the polishing chamber.

In the above-described conventional rice polishing machine, the revolution of rice grains caused by the rotation of the polishing roll is prevented because of their own weight, and the rice grains tend to be collected in the lower portion of the polishing chamber, thereby increase the density of rice grains in the lower portion of the polishing chamber and decreasing the density of rice grains in the upper portion of the polishing chamber.

In the above-described Satake patent, the decrease in rice grain density in the upper portion of the polishing chamber is positively utilized to discharge the bran and heat generated by the polishing action in the lower portion of the polishing chamber through the upper portion of the polishing chamber in which the rice grain density is low, by means of air introduced into the polishing chamber from the lower space, thereby enhancing the bran removing efficiency and suppressing effectively the rise in temperature in the polishing chamber.

With the arrangement described above, however, it has been found that the rice grains in the polishing chamber tend to be stagnated in the lower portion of the polishing chamber and such stagnation adversely affects the polishing action. This causes the rice grain density in the lower portion of the polishing chamber to be considerably increased. The rice grains, having the considerably high density, stagnated in the lower portion of the polishing chamber are subjected to an excessive pressure from the polishing roll, so that a speed of rotation of each rice grain about its own axis is decreased. The reduction in the rotational speed of each rice grain about its own axis causes such a problem that an outer surface of each rice grain is abraded non-uniformly by the polishing roll. Also, since the rice grains stagnated in the lower portion of the polishing chamber are high in density, it is difficult for the air introduced from the lower space into the polishing chamber to pass through the stagnant rice grains, so that the performance of carrying away the removed bran to the outside of the polishing chamber is reduced. Furthermore, the high density rice grains stagnated in the lower portion of the polishing chamber is subjected to an excessive pressure from the polishing roll and is broken to produce broken or damaged rice grains. Moreover, the revolution speed of the rice grains is increased in the upper portion of the polishing chamber where the rice grain density is low, due to their own weight, so that the rice grains impinge against the rice grains stagnated in the lower portion of the polishing chamber, and against the wall of the perforated cylindrical polishing member, to cause the broken rice grains.

SUMMARY OF THE INVENTION

An object of the present invention is to provide a rice polishing machine which improves a uniformity of density of rice grains over an entire polishing chamber.

According to the present invention, there is provided a machine for polishing rice grains comprising a frame; a shaft supported by the frame for rotation about an axis generally extending horizontally; a polishing roll mounted on the shaft for rotation therewith; a perforated cylindrical polishing assembly mounted in substantially concentric relation to the axis, the perforated cylindrical polishing assembly cooperating with the polishing roll to define a polishing chamber between an outer circumferential surface of the polishing roll and an inner circumferential surface of the perforated cylindrical polishing assembly, the polishing chamber having an inlet and an outlet; supply means communicating with the inlet of the polishing chamber for supplying rice grains to be polished into the polishing chamber; drive means drivingly connected to the shaft for rotating the shaft to rotate the polishing roll relative to the perforated cylindrical polishing assembly, to thereby polish the rice grains within the polishing chamber, to remove a surface bran layer from each of the rice grains, the polished rice grains being discharged from the polishing chamber through the outlet thereof; partition wall means engaging with an outer circumferential surface of the perforated cylindrical polishing assembly at a location below the axis of the shaft, for dividing the outer circumferential surface into an arcuate bottom surface section and the remaining arcuate surface section and for defining a lower space to which the arcuate bottom surface section is exposed and an upper space to which the remaining arcuate surface section is exposed; and air flow means for causing air to flow from the lower space into the polishing chamber through apertures in the arcuate bottom surface section of the perforated cylindrical polishing assembly and then to flow from the polishing chamber into the upper space through apertures in the remaining arcuate surface section of the porforated cylindrical polishing assembly, to thereby impart an upward force to the rice grains within a bottom portion of the polishing chamber.

DETAILED DESCRIPTION OF THE PREFERRED EMBODIMENTS

Figure 1:
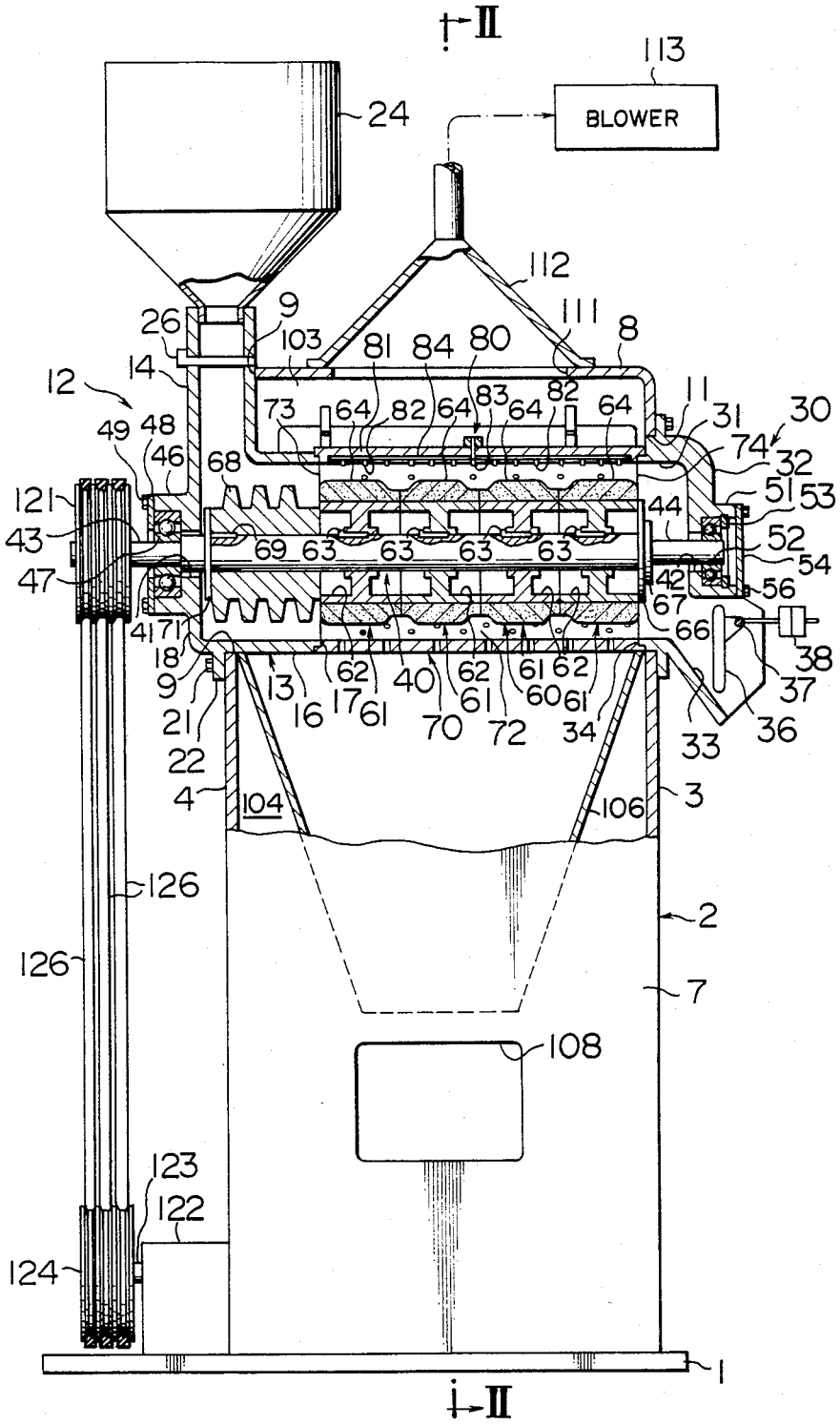
FIG. 1 is a side elevational view, partially cross-sectioned vertically and longitudinally, showing a rice polishing machine in accordance with an embodiment of the invention.
Figure 2:
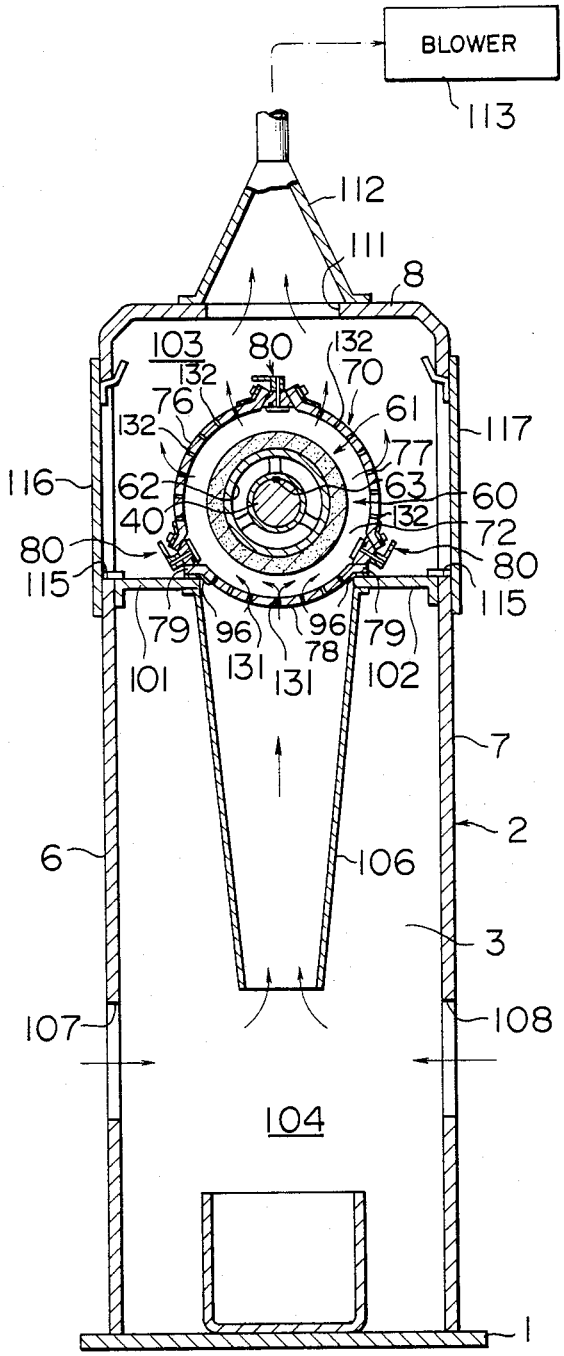
FIG. 2 is a cross-sectional view taken along a line II—II of FIG. 1.

Referring now to FIGS. 1 and 2, a rice polishing machine in accordance with an embodiment of the invention includes a base 1 and a frame, generally designated by the reference numeral 2, fixedly mounted on the base 1. The frame 2 has a front wall 3, a rear wall 4, a pair of side walls 6 and 7 and a top wall 8. A rear opening 9 is formed at a corner defined by the rear wall 4 and the top wall 8 and a front opening 11 is formed in the front wall 3.

An L-shaped inlet duct unit, generally designated by the reference numeral 12, is fitted into the rear opening 9 and comprises a horizontal duct section 13 and a vertical duct section 14 which are integrally connected to each other. The horizontal duct section 13 includes a cylindrical wall 16 having an axial open one end 17, and an end wall 18 formed integrally with the cylindrical wall 16 at the other axial end of the cylindrical wall 16. The inlet duct unit 12 is secured to the frame 2 by bolts 21 passing through an annular flange 22 extending outwardly from the cylindrical wall 16 in integral relation thereto. The vertical duct section 14 having a rectangular cross-sectional shape extends upwardly from the top of the cylindrical wall 16 and has an upper end connected to a hopper 24 for receiving therein rice grains to be polished. A retractable shutter, i.e., valve 26 is movable between a closed position, shown in FIG. 1, where the vertical duct section 14 is closed and an open position where the vertical duct section is opened.

An outlet duct unit, generally designated by the reference numeral 30, is fitted into the front opening 11 formed in the front wall 3 of the frame 2. The duct unit 30 includes a cylindrical wall 31 having an axial open one end 34, and an end wall 32 formed integrally with the cylindrical wall 31 at the other axial end thereof. A channel member 33 having a generally U-shaped cross-section is connected integraly to the cylindrical wall 31 and to the end wall 32 and extends obliquely downwardly of a corner defined by the cylindrical wall 31 and the end wall 32. A pressure plate 36 is swingable around an axis of a pivot 37 extending between side walls of the channel member 33 and is normally biased by a counterweight 38 in the clockwise direction in FIG. 1.

A shaft 40 having a substantially horizontally extending axis extends through an opening 41 formed in the end wall 18 of the inlet duct unit 12 and through an opening 42 formed in the end wall 32 of the outlet duct unit 30. The shaft 40 has a reduced diameter one end portion 43 and the other reduced diameter end portion 44. The one end portion 43 is rotatably supported by a bearing 47 received in a space defined by an annular wall 46 which is formed integrally with end wall 18 of the inlet duct unit 12 so as to extend outwardly therefrom. A retainer plate 48 is fastened to an end face of the annular wall 46 by bolts 49 so as to hold the bearing 47 in position. The other end portion 44 of the shaft 40 is rotatably supported by a bearing 52 received in a space defined by an annular wall 51 which is formed integrally with the end wall 32 of the outlet duct unit 30 so as to extend outwardly therefrom. The bearing 52 is held in position by a spring retainer 53. A cover plate 54 is fastened to an end face of the annular wall 51 by bolts 56 so as to prevent foreign matters or dusts from invading into the bearing 52. Thus, the shaft 40 is supported by the frame 2 through the inlet and outlet duct units 12 and 30 so as to be rotatable around the generally horizontal axis.

A polishing roll, generally designated by the reference numberal 60, is mounted on the shaft 40 for rotation therewith. The polishing roll 60 comprises four roll sections 61 which are mounted in coaxial relation to each other on the shaft 40. Each of the roll sections 61 includes a wheel 62 mounted on the shaft 40 for rotation therewith by means of a key 63 and a grindstone 64 mounted securely to an outer circumferential surface of the wheel 62. The roll section 61 disposed adjacent to the other reduced diameter end portion 44 of the shaft 40 abuts against a retainer plate 66 pressed against a shoulder defined by the other reduced diameter end portion 44 of the shaft 40, by means of a threaded ring 67.

A screw feeder 68 disposed within the cylindrical wall 16 of the inlet duct unit 12 is mounted on the shaft 40 for rotation therewith by means of a key 69. The screw feeder 68 is pressed against an end face of the roll section 61, disposed adjacent to the reduced diameter one end portion 43 of the shaft 40, by a retainer plate 71 threadedly engaging with the shaft 40.

A stationary perforated cylindrical polishing assembly, generally designated by the reference numeral 70, has an axial one end fitted onto the open end 17 of the cylindrical wall 16 of the inlet duct unit 12 and the other axial end fitted onto the open end 34 of the cylindrical wall 31 of the outlet duct unit 30. The perforated cylindrical polishing assembly 70 is disposed in generally concentric relation to the axis of the shaft 40 to define an annular polishing chamber 72 between the outer circumferential surface of the polishing roll 60 and the inner circumferential surface of the perforated cylindrical polishing assembly 70. The polishing chamber 72 has an inlet 73 communicating with the hopper 24 through the inlet duct unit 12 and an outlet 74 communicating with the outlet duct unit 30.

Figure 3:
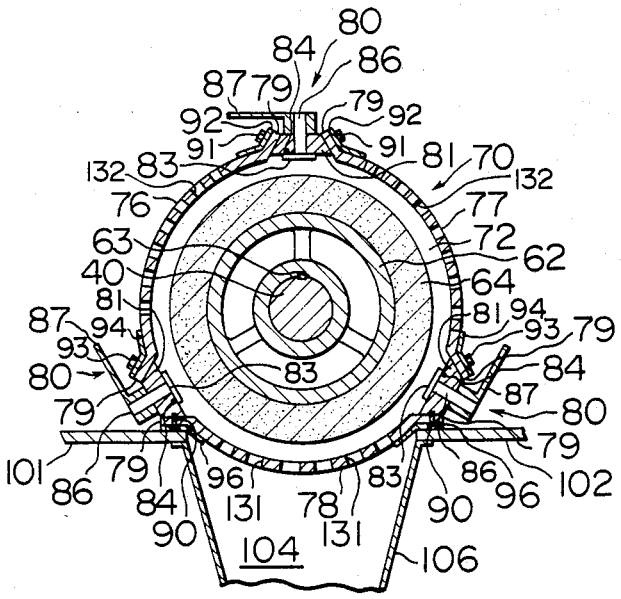
FIG. 3 is an enlarged cross-sectional view showing a perforated cylindrical polishing assembly shown in FIGS. 1 and 2.

As will be understood from FIG. 3, the perforated cylindrical polishing assembly 70 comprises three arcuate perforated wall members 76, 77 and 78. The arcuate wall members 76, 77 and 78 are provided therein with apertures identical in opening area to each other and spaced at the same pitch. Each of the perforated arcuate wall members 76, 77 and 78 is provided with integral flanges 79 along its longitudinal edges. A rice grain flow guide assembly generally designated by the reference numeral 80 is disposed between each pair of adjacent flanges 79 and 79. The rice grain flow guide assembly 80 comprises an elongated body 81 having a trapezoidal cross-sectional shape, a plurality of vanes 82, 83 arranged along the elongated body 81 (see FIG. 1), a rod 84 disposed within a longitudinal groove formed along the elongated body 81 and pivotally connected to the plurality of vanes 82, 83 to connect the vanes to each other (also see FIG. 1), and a pin 86 having one end thereof secured to the center vane 83 and the other end secured to an operating lever 87. When the operating lever 86 is angularly moved around an axis of the pin 87, the center vane 83 is angularly moved. The annular movement of the center vane 83 is transmitted to the other vanes 82 so that the vanes 82, 83 are angularly moved together, thereby guiding the rice grains flowing within the polishing chamber 72.

Referring again to FIG. 3, the adjacent flanges 79 and 79 on the arcuate perforated wall members 76 and 77 of the perforated cylindrical polishing assembly 70 are fastened to the body 81 of the rice grain flow guide assembly 80 by bolts 91 through respective retainer plates 92. The adjacent flanges 79 and 79 on the arcuate perforated wall members 76 and 77 adjacent to the arcuate perforated wall member 78 are respectively fastened to the bodies 81 through respective retainer plates 94 by bolts 93. The both flanges 79 and 79 on the perforated wall member 78 are respectively fastened to the adjacent bodies 81 by bolts 90 having their respective heads provided therein with hexagonal bores, through respective retainer plates 96. Thus, the three perforated wall members 76, 77 and 78 are connnected to each other in a cylindrical shape.

Referring to FIGS. 2 and 3, each of a pair of horizontal partition wall members 101 and 102 respectively disposed on the opposite sides of the shaft 40 has one longitudinal side edge secured to the associated side wall 6, 7 of the frame 2 and the other longitudinal side edge sealingly engaging with the outer surface of the arcuate perforated wall member 78 at a location below the axis of the shaft 40 through the associated retainer plate 96. The partition wall members 101 and 102 constitute partition wall means for dividing the outer circumferential surface of the perforated cylindrical polishing assembly 70 into an arcuate bottom surface section and the remaining arcuate surface section and for defining an upper space 103 and a lower space 104. The arcuate bottom surface section comprises substantially an outer surface of the arcuate perforated wall member 78 exposed to the lower space 104 whereas the remaining arcuate surface section comprises substantially outer surfaces of the arcuate perforated wall members 76 and 77 exposed to the upper space 103. An air flow guide duct 106 having a generally rectangular cross-sectional shape extends downwardly from the other longitudinal side edges of the partition wall members 101 and 102 so as to converge downwardly and has a lower opening end terminating at a location just above suction openings 107 and 108 formed in the side walls 6 and 7 of the frame 2, respectively.

As best shown in FIGS. 1 and 2, the upper space 103 defined by the partition wall members 101 and 102 is substantially closed by the upper portions of the front wall 3, the rear wall 4 and side walls 6 and 7 and the top wall 8, to define a suction chamber. The top wall 8 is provided with an opening 111 communicating with the suction chamber, i.e., upper space 103. A duct 112 is attached to the top wall 8 by suitable fasteners such as bolts, and has an upstream end communicating with the opening 111 in the top wall 8 and a downstream end communicating with a blower 113, so that upon the operation of the blower 113, air is discharged from the suction chamber, i.e., upper space 103 through the opening 111 and the duct 112 to the outside.

As best shown in FIG. 2, the side walls 6 and 7 of the frame 2 are provided with access openings 115 capable of being closed by detachable cover members 116 and 117, respectively, so as to be accessible to the perforated cylindrical polishing assembly 70 for the purpose of maintenance and replacement.

As shown in FIG. 1, a grooved pulley 121 is mounted on the reduced diameter one end portion 43 of the shaft 40 for rotation therewith. A drive motor 122 mounted on the base 1 has an output shaft 123. A grooved pulley 124 is mounted on the output shaft 123 for rotation therewith. A plurality of belts 126 are trained around the pulleys 121 and 124 so as to transmit a rotational torque of the drive motor 122 to the shaft 40.

An operation of the above-described rice polishing machine in accordance with the embodiment of the invention will now be described.

The hopper 24 which constitutes supply means communicating with the inlet 73 of the polishing chamber 72 through the inlet duct unit 12 for supplying rice grains to be polished into the polishing chamber is filled with the rice grains to be polished. With the retractable valve 26 in its closed position, the motor 122 is energized to rotate the shaft 40 through the pulley 124, belts 126 and pulley 121, and rotate the screw feeder 68 and the polishing roll 60 mounted on the shaft 40. The blower 113 is energized, so that as indicated by the arrows in FIG. 2, the air flows through the respective openings 107 and 108 in the side walls 6 and 7 of the frame 2, apertures 131 in the arcuate perforated wall member 78 of the perforated cylindrical polishing assembly 70, the polishing chamber 72, apertures in the remaining arcuate perforated wall members 76 and 77, the opening 111 in the top wall 8 of the frame 2 and the duct 112. When the retractable valve 26 is moved to its open position, the rice grains to be polished are introduced into the horizontal duct section 13 through the vertical duct section 14 and are fed into the polishing chamber 72 through the inlet 73 thereof by the screw feeder 68. In a manner well known in the art, the rice grains fed into the polishing chamber 72 are polished by grinding or abrasive action of the outer circumferential surface of the polishing roll 60 rotating at a high speed so that bran is removed from the outer surface of each rice grain. The removed bran is discharged from the polishing chamber 72 through the apertures in the arcuate perforated wall members 76 and 77 of the perforated cylindrical polishing assembly 70, the upper space 103, the opening 111 and the duct 112 to the outside by means of the air flow generated by the blower 113. The polished rice grains are discharged from the polishing chamber 72 through its outlet 74 and the outlet duct unit 30 against the resistance of the pressure plate 36.

In the rice polishing machine in accordance with the above-described embodiment of the invention, the blower 113 constitutes air-flow means for causing air to flow from the lower space 104 into the polishing chamber 72 through the apertures 131 of the perforated arcuate wall member 78 which constitutes the arcuate bottom surface section of the perforated cylindrical polishing assembly 70, and then to flow from the polishing chamber 72 to the upper space 103 through the apertures 132 in the remaining arcuate perforated wall members 76 and 77 of the perforated cylindrical polishing assembly 70, thereby to apply an upwardly directed force to the rice grains within the lower portion of the polishing chamber 72. The air flow flowing into the polishing chamber 72 through the apertures 131 in the arcuate perforated wall member 78 applies the upward force to the rice grains which tend to be collected and stagnated in the lower portion of the polishing chamber 72, to reduce a density of the rice grains in the lower portion of the polishing chamber 72 and to make the density of rice grains uniform in the entire circumference of the polishing chamber 72. The reduction in density of rice grains in the lower portion of the polishing chamber 72 promotes the rotation of each rice grain around its own axis and prevents the outer surface of each rice grain from being abraded non-uniformly by the polishing roll 60. In addition, the reduction in density of rice grains in the lower portion of the polishing chamber 72 facilitates the air flow from the lower space 104 into the upper space 103 through the polishing chamber 72, to thereby enhance the performance of discharging the removed bran to the outside of the polishing chamber 72. Furthermore, the reduction in density of rice grains in the lower portion of the polishing chamber 72 effectively prevents the rice grains from being subjected to an excessive pressure from the polishing rolls 60 so as to be broken. Moreover, the density of rice grains in the upper portion of the polishing chamber 72 is appropriately increased, whereby the increase in the revolution speed of rice grains due to their own weight is prevented, to thereby obviate such a problem that the rice grains revolving at a high speed would impinge against the wall of the perforated cylindrical polishing assembly 70 so as to be broken.

As described previously, the apertures in the arcuate perforated wall members 76, 77 and 78 of the perforated cylindrical polishing assembly 70 are equal to each other in diameter, i.e., opening area and are spaced from each other at the same pitch. The apertures 131 in the arcuate perforated wall member 78 exposed to the lower space 104 are less in number than the apertures 132 in the remaining arcuate perforated wall members 76 and 77 exposed to the upper space 103. In other words, the total sum of the opening areas of the apertures 131 in the arcuate perforated wall member 78 is less than that of the opening areas of the apertures 132 in the remaining arcuate perforated wall members 76 and 77. Accordingly, the flow speed or velocity of the air passing through the apertures 131 in the arcuate perforated wall member 78 is higher than that of the air passing through the apertures 132 in the remaining arcuate perforated wall members 76 and 77. The air flow having its high velocity introduced into the polishing chamber 72 through the apertures 131 in the arcuate perforated wall member 78 imparts an effective upward force to the rice grains which tend to be collected and stagnated in the lower portion of the polishing chamber 72 so that the density of the rice grains tends to be further uniformed around the entire circumference of the polishing chamber 72.

Figure 4:
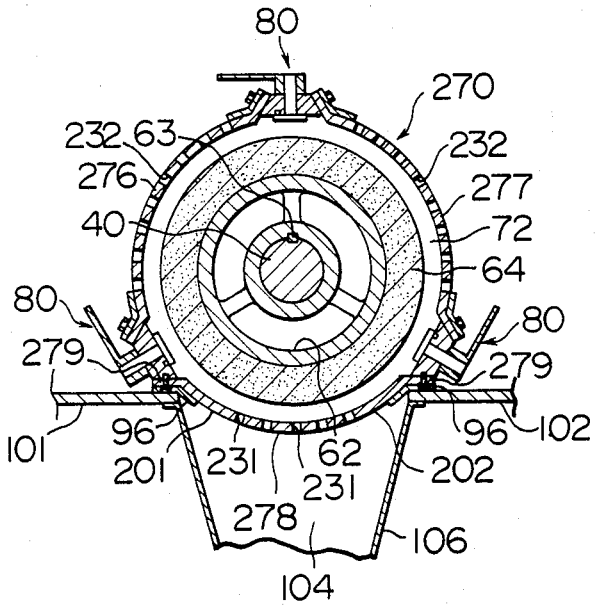
FIG. 4 is a cross-sectional view, similar to FIG. 3, but showing a second embodiment of the perforated cylindrical polishing assembly.

FIG. 4 is a view similar to FIG. 3, but showing a second embodiment of a perforated cylindrical polishing assembly. In FIG. 4, the same reference numerals are used to designate the same members or components shown in FIGS. 1 through 3. In FIG. 4, the perforated cylindrical polishing assembly in accordance with the second embodiment is generally designated by the reference numeral 270. The perforated cylindrical polishing assembly 270 has arcuate perforated wall members 276, 277 and 278. The arcuate perforated wall members 276 and 277 are similar in structure to the arcuate perforated wall members 76 and 77 shown in FIG. 3. The arcuate wall member 278 constituting an arcuate bottom surface section of the stationary perforated cylindrical polishing assembly 270 is provided with apertures 231 which are equal in diameter, i.e., opening area and pitch to apertures 232 in the remaining arcuate wall member 276 and 277. However, the arcuate perforated wall member 278 is provided with imperforate wall portions 201 and 202 respectively extending longitudinally along flanges 279 thereof, so that the apertures 231 in the arcuate perforated wall member 278 are considerably reduced in number than those in the remaining arcuate perforated wall members 276 and 277. In the embodiment shown in FIG. 4, the total sum of opening areas of the apertures 231 in the arcuate perforated wall member 278 exposed to the lower space 104 is less than that of the apertures 232 in the arcuate perforated wall member 78 shown in FIG. 3. Accordingly, a flow speed or velocity of air passing through the apertures 231 in the arcuate perforated wall member 278 is considerably higher than that of air passing through the apertures 232 in the remaining arcuate perforated wall members 276 and 277, to thereby apply more effective upward force to the rice grains which otherwise tend to be collected and stagnated in the lower portion of the polishing chamber 72. In addition, since the apertures 231 in the arcuate perforated wall member 278 open adjacent to the lowermost portion of the polishing chamber 72, the apertures 231 enable the upward air flow having high velocity to be applied to the rice grains in the lowermost portion of the polishing chamber 72 where the rice grains are liable to be stagnant.

Figure 5:
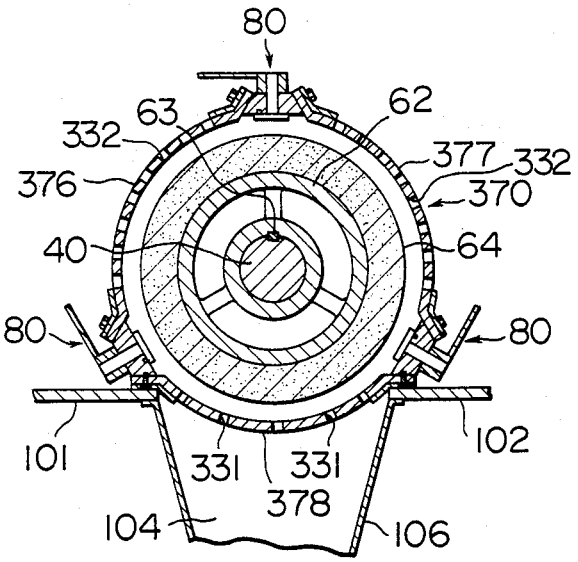
FIG. 5 is a cross-sectional view, similar to FIG. 3, but showing a third embodiment of the perforated cylindrical polishing assembly.

FIG. 5 is a view similar to FIG. 3, but showing a third embodiment of a perforated cylindrical polishing assembly. In FIG. 5, the same reference numerals are used to designate the same members or components shown in FIGS. 1 to 3. In FIG. 5, a perforated cylindrical polishing assembly 370 in accordance with the third embodiment comprises arcuate perforated wall members 376, 377 and 378. The arcuate perforated wall members 376 and 377 are the same in stucture as the arcuate perforated wall members 76 and 77 shown in FIG. 3. The arcuate perforated wall member 378 consituting an arcuate bottom surface section of the stationary perforated cylindrical polishing assembly 370 is provided with apertures 331 which are the same in diameter as the apertures 332 in the remaining arcuate perforated wall members 276 and 377. However, the apertures 331 in the arcuate perforated wall member 378 are spaced from each other at a pitch greater than that at which the apertures 332 in the arcuate perforated wall members 376 and 377 are spaced from each other. In the embodiment shown in FIG. 5, the total sum of opening areas of the apertures 331 in the arcuate perforated wall member 378 exposed to the lower space 104 is less than that in the arcuate perforated wall member 78 shown in FIG. 3. Accordingly, the flow velocity of air passing through the apertures 331 in the arcuate perforated wall member 378 is considerably higher than that of air passing through the apertures 332 in the remaining arcuate perforated wall members 376 and 377, so that a further effective upward force is imparted to the rice grains which are liable to be collected and stagnated in the lower portion of the polishing chamber 72.

Figure 6:
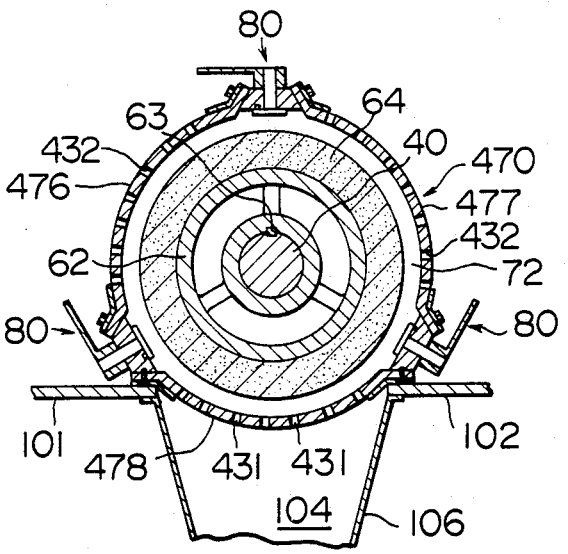
FIG. 6 is a cross-sectional view, similar to FIG. 3, but showing a fourth embodiment of the perforated cylindrical polishing assembly.

FIG. 6 is a view similar to FIG. 3, but showing a fourth embodiment of a perforated cylindrical polishing assembly. In FIG. 6, the same reference numerals are used to designate the same members or components as shown in FIGS. 1 to 3. In FIG. 6, a perforated cylindrical polishing assembly 470 in accordance with the fourth embodiment comprises arcuate perforated wall members 476, 477 and 478. The arcuate perforated wall members 476 and 477 are the same in structure as the arcuate perforated wall members 76 and 77 shown in FIG. 3. The apertures 431 in the arcuate perforated wall member 478 constituting an arcuate bottom surface section of the stationary perforated cylindrical polishing assembly 470 are spaced from each other at the same pitch as that of the apertures 432 in the remaining arcuate perforated wall members 476 and 477. However, each of the apertures 431 in the arcuate perforated wall member 478 exposed to the lower space 104 has a diameter or opening area smaller than that of each aperture 432 in the arcuate perforated wall member 78 shown in FIG. 3. Accordingly, the flow velocity of air passing through the apertures 431 in the arcuate perforated wall member 478 is considerably higher than that of air passing through the apertures 432 in the remaining arcuate perforated wall members 476 and 477, so as to impart a further effective upward force to the rice grains which are liable to be collected and stagnated in the lower portion of the polishing chamber 72.

Figure 7:
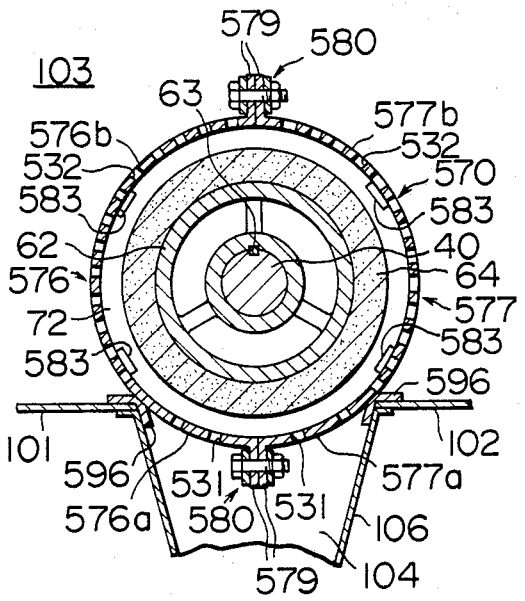
FIG. 7 is a cross-sectional view, similar to FIG. 3, but showing a fifth embodiment of the perforated cylindrical polishing assembly.

FIG. 7 is a view similar to FIG. 3, but showing a fifth embodiment of a perforated cylindrical polishing assembly. In FIG. 7, the same reference numerals are used to designate the same members or components as shown in FIGS. 1 to 3. In FIG. 7, the perforated cylindrical polishing assembly 570 in accordance with the fifth embodiment comprises two perforated wall members 576 and 577 each having a semicircular cross section extending through an angle of 180°. Each of the perforated wall members 576 and 577 is provided with integral flanges 579 formed along its longitudinal side edges. The adjacent flanges 579 and 579 are fastened to each other by bolt and nut assemblies 580, so that the two perforated wall members 576 and 577 are connected to each other in a cylindrical shape. Vanes 583 corresponding, in function, to the rice grain flow guide vanes 83 described with reference to FIGS. 1 to 3 are fixedly secured to inner surfaces of the perforated wall members 576 and 576. In addition, the perforated cylindrical polishing assembly 570 engages with the partition wall members 101 and 102 through respective bent strips 596. Each of the perforated wall members 576 and 577 has arcuate surface sections **576*a*, 577*a* exposed to the lower space 104 and the remaining arcuate surface sections 576*b*, 577*b* exposed to the upper space 103. The remaining arcuate surface sections 576*b* and 577*b* have therein apertures 532 the same in diameter and pitch as each other. However, the arcuate surface sections 576*a* and 577*a* exposed to the lower space 104 have therein apertures 531 spaced from each other at a pitch greater than that between the apertures 532 in the remaining arcuate surface sections 576*b* and 577*b*. Similar to the embodiment described with reference to FIG. 5, in the embodiment shown in FIG. 7, the total sum of opening areas of the apertures 531 in the arcuate surface sections 576*a* and 577*a* exposed to the lower space 104 is less than that of the apertures 131 in the arcuate perforated wall member 78 shown in FIG. 3. Accordingly, the flow velocity of air passing through the apertures 531 in the arcuate surface sections 576*a* and 577*a* is considerably higher than that of air passing through the apertures 532 in the remaining arcuate surface sections 576*b* and 577*b*, so as to impart further effective upward force to the rice grains which are liable to be collected and stagnated in the lower portion of the polishing chamber 72**.

In the above described rice polishing machine in accordance with the embodiments of the invention, the construction in which the upper space 103 is substantially closed and air is discharged from the upper space 103 by the blower 113 has been illustrated and described. However, the upper space 103 may open. In such case, the lower space 104 is substantially closed, and pressurized air is introduced into the closed lower space.

What I claim is:

1. A machine for polishing rice grains comprising, a frame;

a shaft supported by said frame for rotation about an axis generally extending horizontally;

a polishing roll mounted on said shaft for rotation therewith;

a perforated cylindrical polishing assembly mounted in substantially concentric relation to said axis, said perforated cylindrical polishing assembly cooperating with said polishing roll to define a polishing chamber between an outer circumferential surface of said polishing roll and an inner circumferential surface of said perforated cylindrical polishing assembly, said polishing chamber having an inlet and an outlet;

supply means communicating with said inlet of said polishing chamber for supplying rice grains to be polished into said polishing chamber;

drive means drivingly connected to said shaft for rotating said shaft to rotate said polishing roll relative to said perforated cylindrical polishing assembly, to thereby polish the rice grains within said polishing chamber, to remove a surface bran layer from each of the rice grains, the polished rice grains being discharged from said polishing chamber through said outlet thereof;

partition wall means engaging with an outer circumferential surface of said perforated cylindrical polishing assembly at a location below said axis of said shaft, for dividing said outer circumferential surface into an arcuate bottom surface section and the remaining arcuate surface section and for defining a lower space to which said arcuate bottom surface section is exposed and an upper space to which said remaining arcuate surface section is exposed; and air flow means for causing air to flow from said lower space into said polishing chamber through apertures in said arcuate bottom surface section of said perforated cylindrical polishing assembly and then to flow from said polishing chamber into said upper space through apertures in said remaining arcuate surface section of said perforated cylindrical polishing assembly, the air flow from the lower space into the polishing chamber through the apertures in the arcuate bottom surface section of the perforated cylindrical polishing assembly being higher in velocity than that of the air flow from the polishing chamber into the upper space through the apertures in the remaining arcuate surface section of the perforated cylindrical polishing assembly, to thereby impart an upward force to the rice grains within the bottom portion of said polishing chamber.

2. A rice polishing machine as claimed in claim 1, wherein the total sum of opening areas of the apertures in said arcuate bottom surface section of said perforated cylindrical polishing assembly is smaller than that of the apertures in the remaining arcuate surface section of said perforated cylindrical polishing assembly, to cause the air flow passing through the apertures in said arcuate bottom surface section to have the velocity higher than that of the air flow passing through the apertures in said remaining arcuate surface section.

3. A rice polishing machine as claimed in claim 2, wherein each of the apertures in said arcuate bottom surface section of said perforated cylindrical polishing assembly has substantially the same opening area as that of each of the apertures in said remaining arcuate surface section of said perforated cylindrical polishing assembly.

4. A rice polishing machine as claimed in claim 3, wherein the apertures in said arcuate bottom surface section of said perforated cylindrical polishing assembly are spaced from each other at substantially the same pitch as that at which the apertures in said remaining arcuate surface section of said perforated cylindrical polishing assembly are spaced from each other, the apertures in said arcuate bottom surface section being less in number than those in said remaining arcuate surface section.

5. A rice polishing machine as claimed in claim 3, wherein the apertures in said arcuate bottom surface section of said perforated cylindrical polishing assembly are spaced from each other at a pitch greater than that at which the apertures in said remaining arcuate surface section of said perforated cylindrical polishing assembly are spaced from each other.

6. A rice polishing machine as claimed in claim 2, wherein the apertures in said arcuate bottom surface section of said perforated cylindrical polishing assembly are spaced from each other at substantially the same pitch as that at which the apertures in said remaining arcuate surface section of said perforated cylindrical polishing assembly are spaced from each other, each of the apertures in said arcuate bottom surface section having an opening area smaller than that of each of the apertures in said remaining arcuate surface section.

7. A rice polishing machine as claimed in any one of claims 1 to 6, wherein said frame cooperates with said partition wall means and said remaining arcuate surface section of said perforated cylindrical polishing assembly to define a substantially closed suction chamber including said upper space, said air flow means including means communicating with said suction chamber for discharging the air therefrom.

8. A rice polishing machine as claimed in claim 7, wherein said perforated cylindrical polishing assembly comprises at least two perforated arcuate wall members, and interconnecting means for interconnecting the adjacent edges of the adjacent perforated arcuate wall members.

9. A rice polishing machine as claimed in claim 8, further comprising a screw feeder mounted on said shaft for rotation therewith for feeding the rice grains to be polished from said supply means into said polishing chamber through said inlet thereof.

10. A rice polishing machine as claimed in claim 9, wherein said polishing roll comprises a plurality of roll sections disposed in coaxial relation to each other, each of said roll sections having a wheel fixedly mounted on said shaft and an annular grindstone secured around said wheel.

11. A rice polishing machine as claimed in claim 10, wherein said partition wall means comprises a pair of partition walls located on opposite sides of said axis of said shaft and extending along said axis, each of said partition walls having one longitudinal edge fixedly mounted on said frame and the other longitudinal edge engaging with said perforated cylindrical polishing assembly.

12. A rice polishing machine as claimed in claim 11, further comprising a duct extending downwardly from the respective other longitudinal edges of said pair of partition walls for guiding the air toward said arcuate bottom surface section of said perforated cylindrical polishing assembly.

* * * * *